US007654256B2

(12) United States Patent
Huang

(10) Patent No.: US 7,654,256 B2
(45) Date of Patent: Feb. 2, 2010

(54) APPARATUS FOR RAPID LOADING AND FIRING PAINTBALLS

(76) Inventor: Mu-Sung Huang, No. 45, Lane 492, Sec. 2, Yuanji Rd., Changhua County (TW)

( * ) Notice: Subject to any disclaimer, the term of this patent is extended or adjusted under 35 U.S.C. 154(b) by 0 days.

(21) Appl. No.: 12/015,046

(22) Filed: Jan. 16, 2008

(65) Prior Publication Data

US 2009/0178660 A1 Jul. 16, 2009

(51) Int. Cl.
*F41B 11/02* (2006.01)
*F41B 11/32* (2006.01)

(52) U.S. Cl. ..... 124/72; 124/73

(58) Field of Classification Search ..... 89/36.01, 89/36.02, 36.03, 36.04, 36.07, 36.08, 36.12, 89/36.17; 124/60, 70, 71, 72, 73, 75
See application file for complete search history.

(56) References Cited

U.S. PATENT DOCUMENTS 5,613,483 A * 3/1997 Lukas et al. ..... 124/73
5,769,066 A * 6/1998 Schneider ..... 124/75
5,962,805 A * 10/1999 Saxby ..... 102/440
6,601,780 B1 * 8/2003 Sheng ..... 239/337
6,986,343 B2 * 1/2006 Carnall et al. ..... 124/75
7,258,114 B2 * 8/2007 Rice ..... 124/72
7,302,943 B2 * 12/2007 Rice ..... 124/31
2005/0115551 A1 * 6/2005 Carnall et al. ..... 124/71
2006/0169266 A1 * 8/2006 Carnall et al. ..... 124/75

* cited by examiner

*Primary Examiner*—Bret Hayes
(74) *Attorney, Agent, or Firm*—Muncy, Geissler, Olds & Lowe, PLLC

(57) ABSTRACT

A paintball gun firing structure includes a moving structure at one end of a firing chamber of a paintball gun and a valve control structure at one end of the moving structure. An air source can be channeled by the moving structure to position a paintball, and the valve control structure can discharge the air source.

1 Claim, 4 Drawing Sheets

APPARATUS FOR RAPID LOADING AND FIRING PAINTBALLS

BACKGROUND OF THE INVENTION

1. Field of the Invention

The present invention relates to an apparatus for rapid loading and firing paintballs and particularly to an improved paintball gun that can load paintballs and replenish pressure quickly.

2. Description of the Prior Art

A conventional paintball gun generally has a paintball holding and loading structure at the rear end of a barrel to load paintballs, and a firing structure at the paintball loading structure which has a trigger depressible to fire the paintballs. Such a structure requires high-pressure air to provide firing power. The high-pressure air is released instantly. It consumes a great deal of air source. The paintball loading structure is easily damaged due to clogging of the paintballs. As the paintball loading structure is moved mechanically, shooting effect often is not desirable. There are still rooms for improvement.

SUMMARY OF THE INVENTION

In view of the disadvantages occurred to the conventional paintball gun the primary object of the invention is to provide an apparatus that has a fast moving means and a valve control structure at a firing chamber end of a paintball gun to rapidly load paintballs and discharge air source at the same time so that the paintballs can be fired quickly and accurately without depleting the air source. The structure is simpler, and the problem of paintball clogging can be prevented. Paintball loading speed increases and pressure can be replenished quickly.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
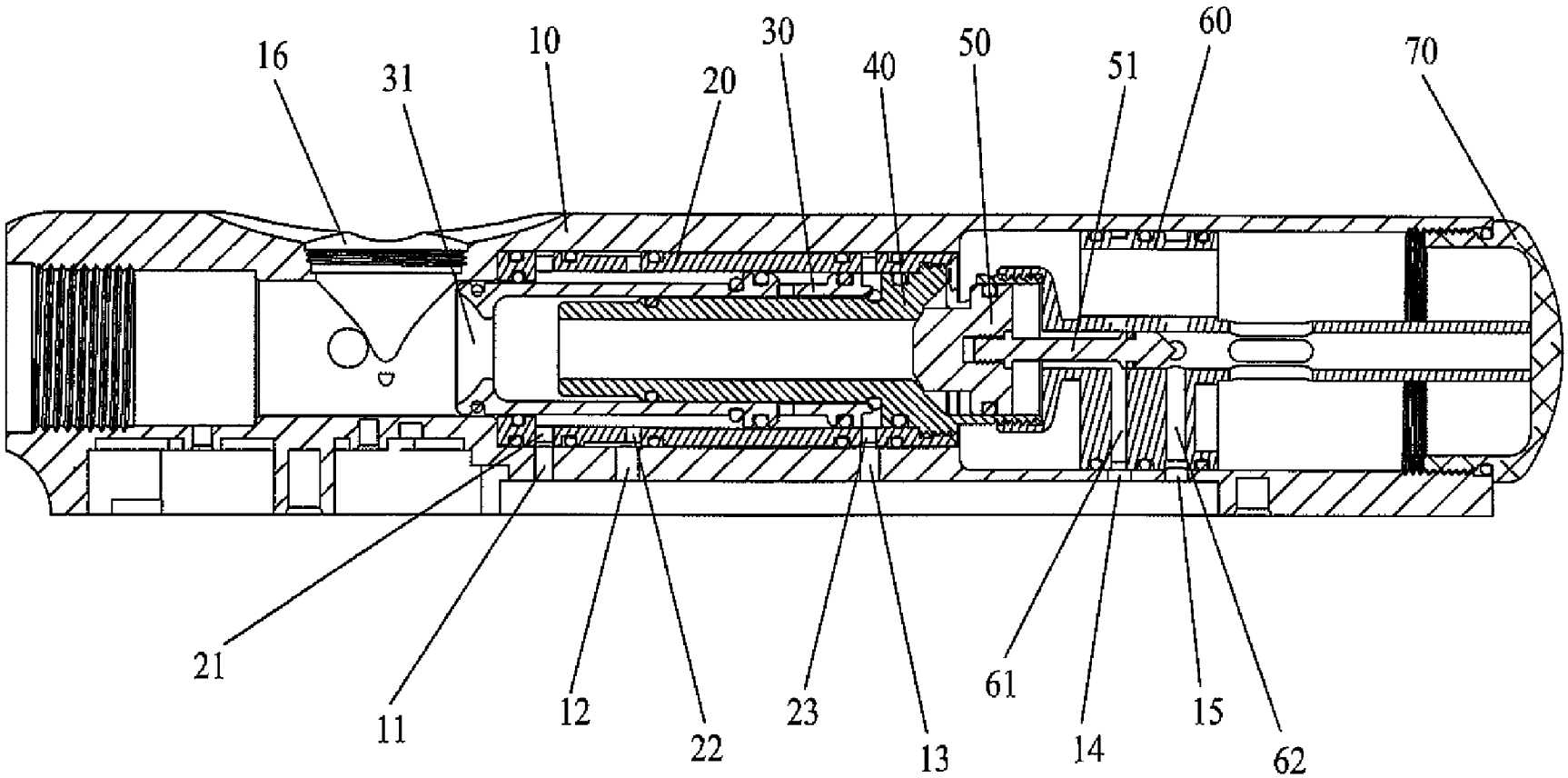
FIG. 1 is a sectional view of the invention.

Please referring to FIG. 1, the present invention aims to be adopted on a paintball gun that has a hollow barrel 10 holding an inner sleeve 20. The inner sleeve 20 holds a plunger 30 in a close contact and slidable fashion. In the plunger 30 there is an air discharge dock 40 fastened to the inner sleeve 20. The air discharge dock 40 has a rear end coupling with a moving valve 50. The moving valve 50 has one end fastened to a driven valve rod 51 and coupled with a valve seat 60 at an outer end. The barrel 10 further has a rear end coupled with a rear cap 70. Thereby a rapid paintball loading and firing structure is formed.

Figure 2:
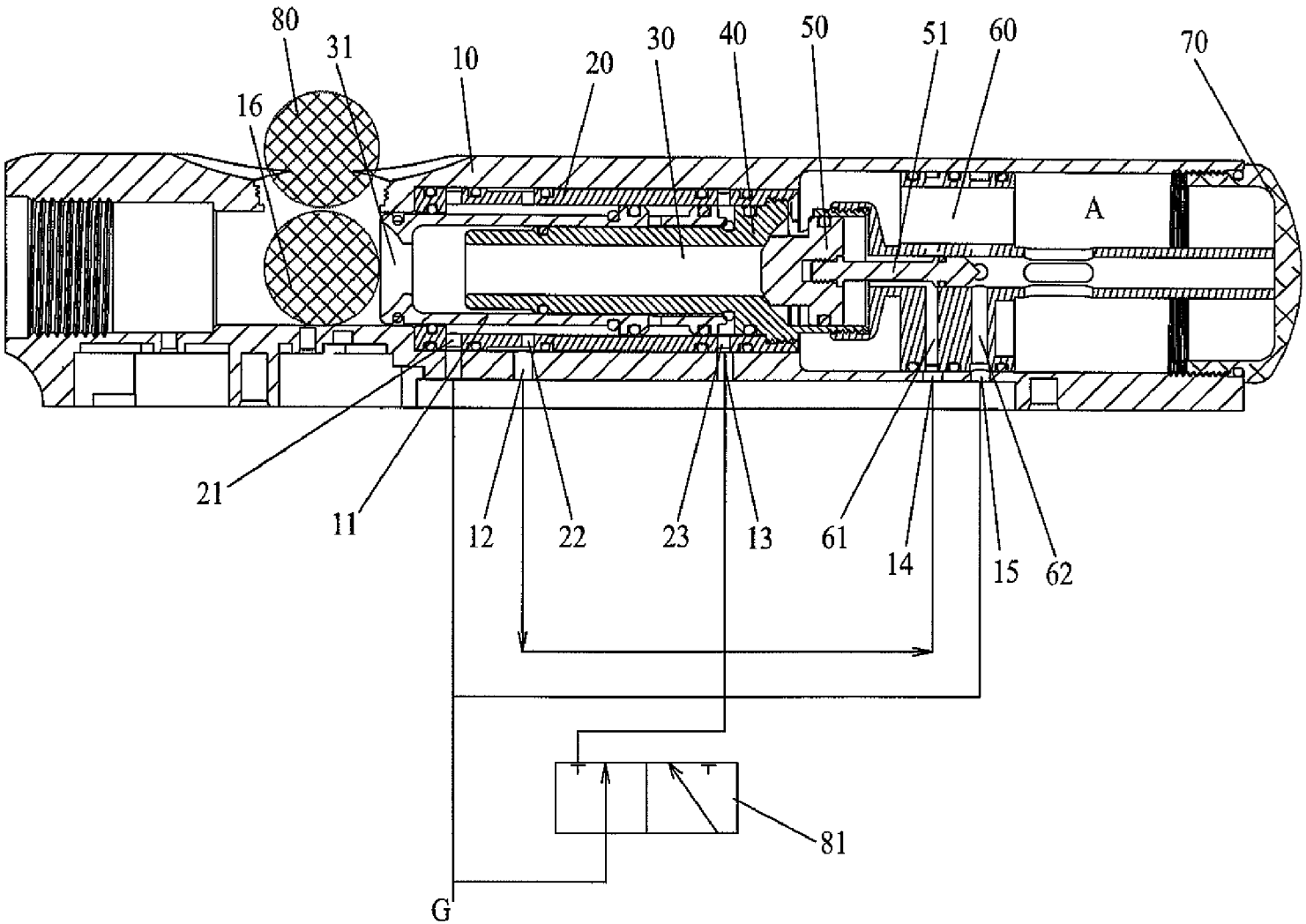
FIGS. 2, 3 and 4 are schematic views of the invention in operating conditions.
Figure 3:
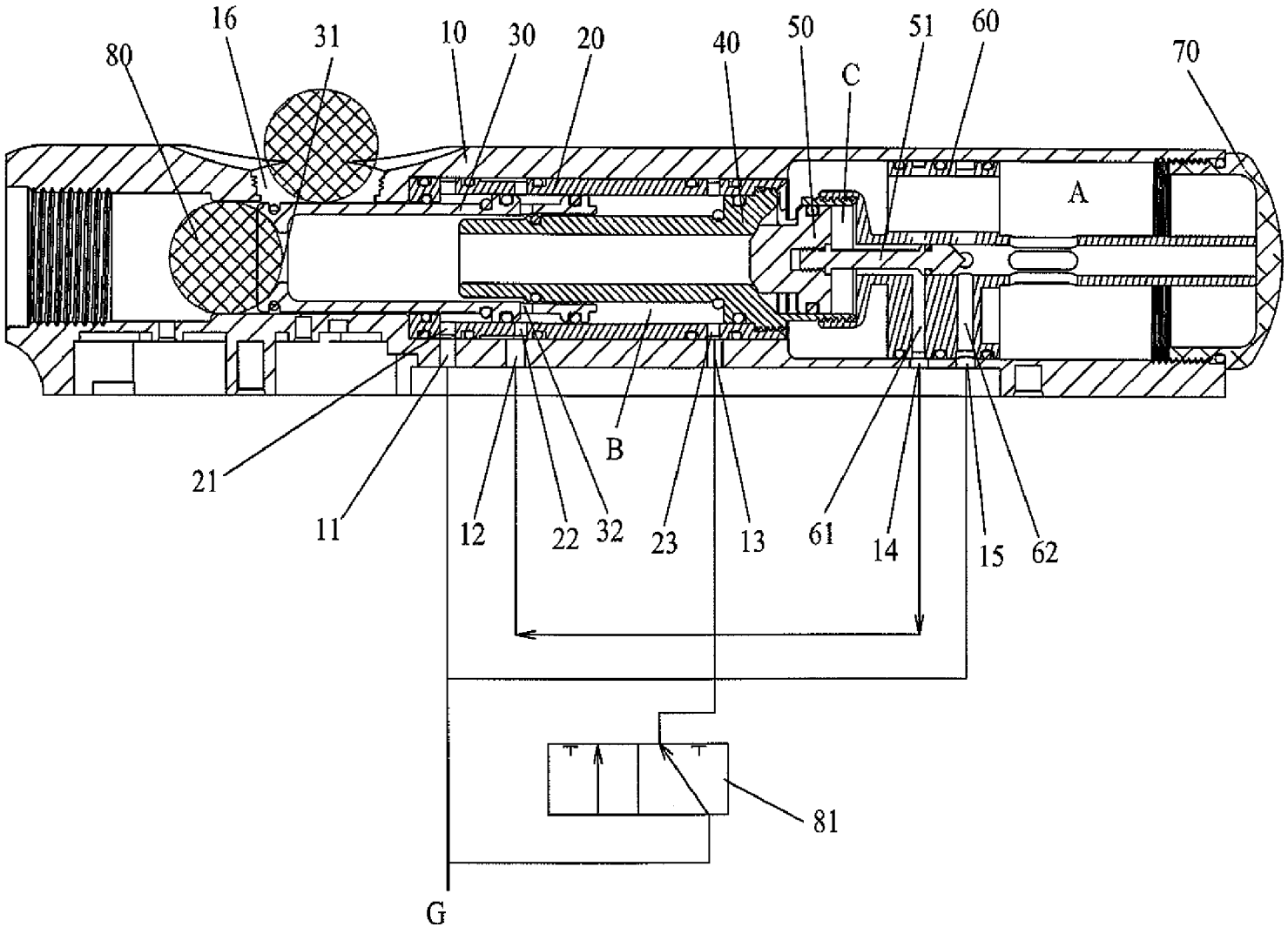
Figure 4:
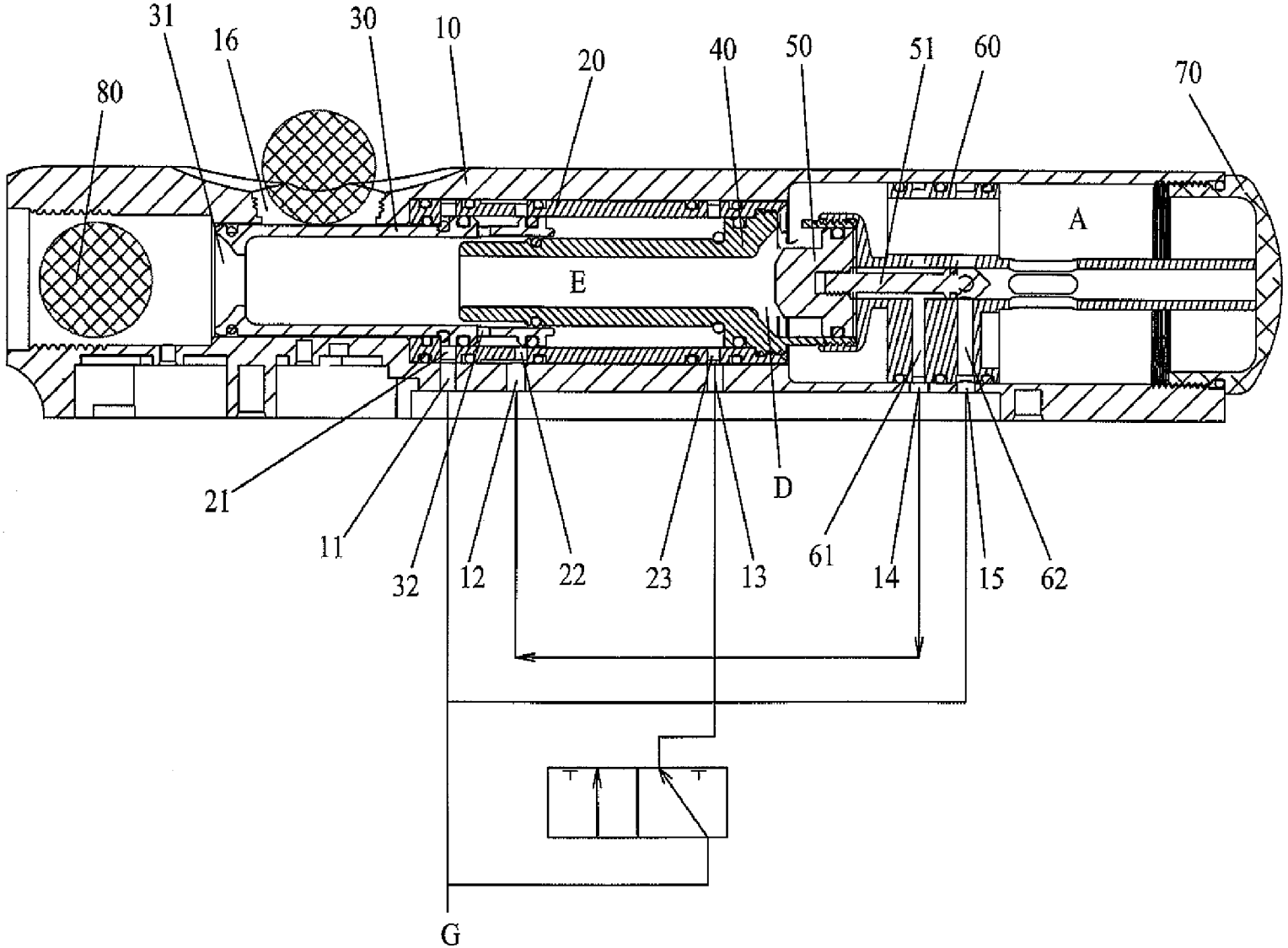

Refer to FIGS. 2, 3 and 4 for operation of the invention. The barrel 10 has a plurality of air inlets 11 and air vents 12, 13, 14 and 15 at the bottom thereof. The inner sleeve 20 and valve seat 60 have respectively air directing ports 21, 22, 23, 61 and 62 corresponding to the air inlets 11 and the air vents 13, 14 and 15. The inner sleeve 20 further has a paintball trough 31 at the front end of the plunger 30. When in use an air source G passes through the air inlets 11 to move the plunger 30 to a selected position at a rear side of a paintball loading orifice 16 of the barrel 10 to be close to a paintball 80. The air inlets 11, air vents 12 and 14, and air directing ports 21, 22 and 61 communicate with one another so that the air source G quickly passes through a gap between the valve seat 60 and the moving valve 50 to seal the moving valve 50 and the air discharge dock 40 without leaking the air. Meanwhile the air source G passes through the air vent 15 and air directing port 62 into the rear end of the barrel 10 to form an air storage space A (referring to FIG. 2).

When firing takes place, the air source G passes through the air vent 13 and air directing port 23 to allow the air to be injected into a first space B formed between the plunger 30 and air discharge dock 40 to move the plunger 30 and the paintball 80 forwards to reach a bottom end of the paintball loading orifice 16 to push the paintball 80 rapidly at a desired position (referring to FIG. 3).

After the plunger 30 has moved the paintball 80 at the desired position, air in a second space C between the valve seat 60 and the moving valve 50 is discharged through another air vent 12, air directing port 22 and an air outlet 32. The pressure in the second space C is released so that the moving valve 50 and the air discharge dock 40 are separated to form a third space D. The air stored at the rear end of the barrel 10 is channeled to a fourth space E formed at an inner end of the plunger 30 from the third space D, while the air in the first space B is directed through the gap between the plunger 30 and air discharge dock 40 into the fourth space E so that the paintball 80 in the paintball trough 31 is blasted off rapidly outside the barrel 10 by a great amount of air to finish the firing operation (referring to FIG. 4). Once the firing operation is finished, the air in the first space B is depleted, the plunger 30 and moving valve 50 are pushed back to their original positions to prepare the loading and firing operation of the next cycle.

As a conclusion, the invention provides an apparatus to rapidly load and fire paintballs. Through the plunger and moving valve deployed in the paintball gun, in cooperating with the air vents and air directing ports, the paintballs can be loaded and fired quickly. The structure is simpler, and clogging of the paintballs is less likely to happen. The paintballs can be loaded quickly and air pressure can be replenished rapidly. It provides a significant improvement over the conventional paintball gun.

I claim:

1. An apparatus for loading and firing paintballs for a paintball gun, comprising:

a hollow barrel;

an inner sleeve located in the barrel;

a plunger located in the inner sleeve in a close contact and slidable fashion;

an air discharge dock located in the plunger and fastened to the inner sleeve;

a moving valve located at a rear end of the air discharging dock;

a driven valve rod fastened to one end of the moving valve;

a valve seat located at an outer end of the moving valve; and a rear cap fastened to a rear end of the barrel;

wherein the barrel has a plurality of air vents at the bottom thereof, the inner sleeve and the valve seat having respectively air directing ports in selective direct communication with the air vents, the inner sleeve having a paintball trough at a front end of the plunger; the air vents receiving an air source which moves the plunger to a selected position at a rear side of a paintball loading orifice of the barrel close to a paintball, and the air vents and the air directing ports communicating with one another to channel the air source through a gap formed between the valve seat and the moving valve so that the moving valve and the air discharge dock are closed to prevent air leaking and the air source passes through the air vents and the air directing ports in a rear end of the barrel to form an air storing space;

wherein the air source is directed through the air vents and the air directing ports when a paintball is fired so that the plunger is moved to the paintball loading orifice to push the paintball to a desired position; and the air in the gap between the valve seat and the moving valve is discharged through the air vents and the air directing ports to separate the moving valve and the air discharge dock, and the air stored at the rear end of the barrel being directed to an inner end of the plunger through the separated moving valve and the air discharge dock such that the paintball in the paintball loading trough is blasted off from the barrel by air;

wherein the paintball is positioned through the plunger and the moving valve in cooperating with the air vents and the air directing ports, and firing of the paintball is accomplished.

* * * * *